US012235078B2

(12) United States Patent
Planck et al.

(10) Patent No.: US 12,235,078 B2
(45) Date of Patent: Feb. 25, 2025

(54) FIREARM ACCESSORY MOUNTING ASSEMBLY

(71) Applicant: Crimson Trace Corporation, Columbia, MO (US)

(72) Inventors: William A. Planck, Columbia, MO (US); Tim Meissen, Columbia, MO (US); Michael Cottrell, Ashland, MO (US); Ryan Donahue, Columbia, MO (US); John Oller, Columbia, MO (US); James Tayon, Moberly, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 17/962,119

(22) Filed: Oct. 7, 2022

(65) Prior Publication Data

US 2023/0213315 A1 Jul. 6, 2023

Related U.S. Application Data

(60) Provisional application No. 63/267,394, filed on Feb. 1, 2022, provisional application No. 63/262,215, filed on Oct. 7, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 5,467,552 A * 11/1995 Cupp ..... F41G 1/26 42/125
6,016,608 A * 1/2000 Lorocco ..... F41G 1/467 33/265
6,318,015 B1 * 11/2001 Baumann ..... F41G 3/323 42/111
6,327,806 B1 * 12/2001 Paige ..... F41G 1/30 42/130
6,477,778 B1 * 11/2002 Lorocco ..... F41G 1/345 33/265
6,513,276 B2 * 2/2003 Mendoza-Orozco ..... F41G 1/26 42/137

(Continued)

OTHER PUBLICATIONS

Outerimpact Red Dot Adapter/Mount for Springfield XD, XD MOD.2, XD(M), XDS Pistol—M.R.A., Amazon.com, https://www.amazon.com/OuterImpact-Adapter-Mount-Springfield-Pistol//dp/B01N7B3WNG/ref-sr_1_5?, may be as early as Nov. 26, 2016, 6 pages.

(Continued)

*Primary Examiner* — Michelle Clement
(74) *Attorney, Agent, or Firm* — Stinson LLP

(57) ABSTRACT

A firearm accessory mount assembly and associated components and methods. The mount assembly can include a mount, at least one dovetail connector, and at least one fastener. The mount can have a first side configured to receive the firearm accessory and a second side configured to engage the firearm. The fastener can be used to secure the dovetail connector in position with respect to the mount and to secure the mount to the firearm. Other constructions and methods are disclosed.

24 Claims, 13 Drawing Sheets

(56) References Cited

U.S. PATENT DOCUMENTS 6,834,457 B1 * 12/2004 Warren ..... F41G 1/10 42/141
7,032,341 B1 * 4/2006 Sconce ..... F41G 1/26 42/111
7,287,351 B1 * 10/2007 Warren ..... F41G 1/10 42/111
7,296,376 B2 * 11/2007 Kidd ..... F41G 1/02 89/41.17
7,481,016 B2 * 1/2009 Gonzalez ..... F41G 11/003 42/127
7,526,890 B1 * 5/2009 Keng ..... F41G 1/26 42/144
7,610,712 B2 * 11/2009 Ertl ..... F41G 1/26 42/137
7,743,546 B2 * 6/2010 Keng ..... F41G 1/32 42/145
7,905,044 B2 * 3/2011 Clouser ..... F41G 1/42 42/130
7,946,075 B2 * 5/2011 Nasef ..... H02G 3/0493 42/141
7,997,023 B2 * 8/2011 Moore ..... F41G 11/003 42/117
8,006,428 B2 * 8/2011 Moore ..... F41G 1/35 42/117
8,006,430 B2 * 8/2011 Wang ..... F41G 11/003 42/129
8,020,335 B2 9/2011 Larsson et al.
8,127,485 B2 * 3/2012 Moore ..... F41G 11/003 42/117
8,296,990 B2 * 10/2012 Zukowski ..... F41A 17/66 42/111
8,769,859 B2 7/2014 Li et al.
8,813,412 B2 8/2014 Rorick
8,832,983 B1 9/2014 Wolf
8,857,097 B2 10/2014 Rorick
8,893,422 B2 11/2014 Wolf
8,919,027 B2 * 12/2014 Curry ..... F41G 1/00 42/144
8,984,797 B2 3/2015 Ballard
9,046,320 B2 6/2015 Keng et al.
9,062,936 B2 6/2015 Zimmer
9,068,801 B1 6/2015 Stecher, Jr. et al.
9,175,926 B2 11/2015 Keng et al.
9,303,955 B2 * 4/2016 Jeung ..... F41G 1/30
9,400,157 B2 7/2016 Pekarek et al.
9,410,770 B2 8/2016 Zimmer
9,441,915 B2 9/2016 Zimmer
9,557,141 B2 1/2017 Capson
9,651,337 B1 * 5/2017 Curry ..... F41G 1/10
9,714,811 B2 * 7/2017 Pulit, Jr. ..... F41G 1/10
9,759,523 B2 9/2017 Pekarek et al.
9,797,687 B2 10/2017 Zimmer
9,846,010 B2 12/2017 Pasfield
9,869,531 B1 1/2018 Zimmer
9,915,502 B2 3/2018 Capson
10,012,471 B1 * 7/2018 Warren ..... F41G 1/10
10,024,628 B2 7/2018 Toner et al.
10,126,098 B2 * 11/2018 Kruse ..... F41G 1/16
RE47,335 E * 4/2019 Wolf ..... F41G 1/00
10,317,163 B2 * 6/2019 Poindexter ..... F41A 23/02
10,330,432 B2 6/2019 Silverman et al.
10,563,955 B2 * 2/2020 Pniel ..... F41G 1/16
10,663,256 B1 * 5/2020 Garbouchian ..... F41G 1/425
10,684,100 B2 * 6/2020 Pniel ..... F41G 1/10
10,753,710 B2 8/2020 Niswander et al.
10,767,960 B2 * 9/2020 Noonan ..... F41G 1/10
10,782,099 B2 * 9/2020 Zimmer ..... F41G 11/006
10,816,309 B2 10/2020 Martindale
10,845,160 B1 * 11/2020 Warren ..... F41G 1/10
10,948,267 B2 * 3/2021 Zimmer ..... F41G 11/006
10,989,355 B2 * 4/2021 Chavez ..... F41G 11/003
11,448,481 B2 * 9/2022 Warren ..... F41G 1/10
11,460,274 B2 * 10/2022 Dawson, Jr. ..... F41G 11/001
11,733,002 B2 * 8/2023 Rosen ..... F41G 11/001 42/113
11,740,053 B2 * 8/2023 Hamilton ..... G02B 27/0189 42/113
2003/0074824 A1 * 4/2003 Arachequesne ..... F41G 1/17 42/111
2004/0211105 A1 * 10/2004 Arachequesne ..... F41G 1/02 42/113
2006/0179703 A1 * 8/2006 Leatherwood ..... F41G 11/003 42/124
2008/0092424 A1 * 4/2008 Keng ..... F41G 1/18 42/137
2013/0219767 A1 * 8/2013 Peterson ..... F41G 1/30 29/428
2017/0030682 A1 * 2/2017 Pearson ..... F41G 11/004
2017/0059277 A1 * 3/2017 Justice ..... F41G 11/003
2018/0195835 A1 * 7/2018 Crispin ..... F41G 1/30
2019/0186869 A1 * 6/2019 Jen ..... F41G 1/345
2019/0323795 A1 10/2019 Zimmer
2020/0272044 A1 4/2020 Walker
2020/0278166 A1 9/2020 Adika
2020/0300581 A1 9/2020 Niswander et al.
2021/0003370 A1 * 1/2021 Martindale ..... F41G 1/02
2021/0033372 A1 2/2021 Zimmer
2021/0055078 A1 2/2021 Roberson
2021/0140740 A1 * 5/2021 Noonan ..... F41G 1/18
2021/0156650 A1 * 5/2021 Harriman ..... F41G 1/10
2023/0228530 A1 * 7/2023 Dawson, Jr. ..... F41G 11/001 42/111

OTHER PUBLICATIONS

CHPWS RDS Adapter Plate for the Walther PPQ Q4 Tactical, YouTube, https://youtume.com/watch?v=_v6RDq6PZ70, Aug. 21, 2020, 2 pages.
Romeo Zero Install on Sig Sauer P320 Dovetail Mount, YouTube, https://www.youtube.com/watch?v=f-NQIm59e74, Jun. 19, 2020, 2 pages.
Shield Sights Read Sight Adapter Mount for the Glock 43, YouTube, https://www.youtube.com/watch?v=LvRKtxeBbRA, Mar. 24, 2020, 2 pages.
XD, XD MOD.2, XD(M)—Outerimpact M.R.A. Plate Installation Instructions, YouTube, https://www.youtube.com/watch?v+dyquEol56wE&t=190s, Aug. 6, 2017, 3 pages.
"C + H Precision Optics Adapter Plate for Gen5 Glock MOS G17 G19 and Trijicon RMR/SRO, Holosun 407C/507C/508C/508T," https://www.amazon.com/CHPWS-Leo-Holosun-Adapter-Plate/dp/BO8HND2134, may be as early as Sep. 8, 2020, 6 pages.

* cited by examiner

FIREARM ACCESSORY MOUNTING ASSEMBLY

CROSS-REFERENCE TO RELATED APPLICATIONS

The present application claims priority to U.S. Provisional Patent App. Nos. 63/262,215, filed Oct. 7, 2021, and 63/267,394, filed Feb. 1, 2022, the entireties of which are hereby incorporated by reference.

FIELD

The present disclosure generally relates to firearm mounts.

BACKGROUND

Firearm mounts generally require use of specialized tools. Improvements are needed.

SUMMARY

In one aspect, a system is for mounting a firearm accessory on a firearm having a dovetail slot. The system comprises a mount configured to receive the firearm accessory thereon. The system includes at least one dovetail connector moveable with respect to the mount. The at least one dovetail connector is sized and shaped to be received in the dovetail slot of the firearm. The system includes at least one fastener configured to engage the dovetail connector to secure the dovetail connector in position with respect to the mount.

In another aspect, a system is for mounting a firearm accessory on a firearm having a dovetail slot. The system comprises a mount having a first side and an opposite second side. The first side is configured to receive the accessory thereon, and the second side is configured to be connected to the firearm. The system includes a shim moveable with respect to the mount and configured to be located between the mount and the firearm when the mount is secured to the firearm. The shim includes mount connection structure, and the mount includes shim connection structure. The shim connection structure and the mount connection structure are configured to be engaged to locate the shim relative to the mount.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
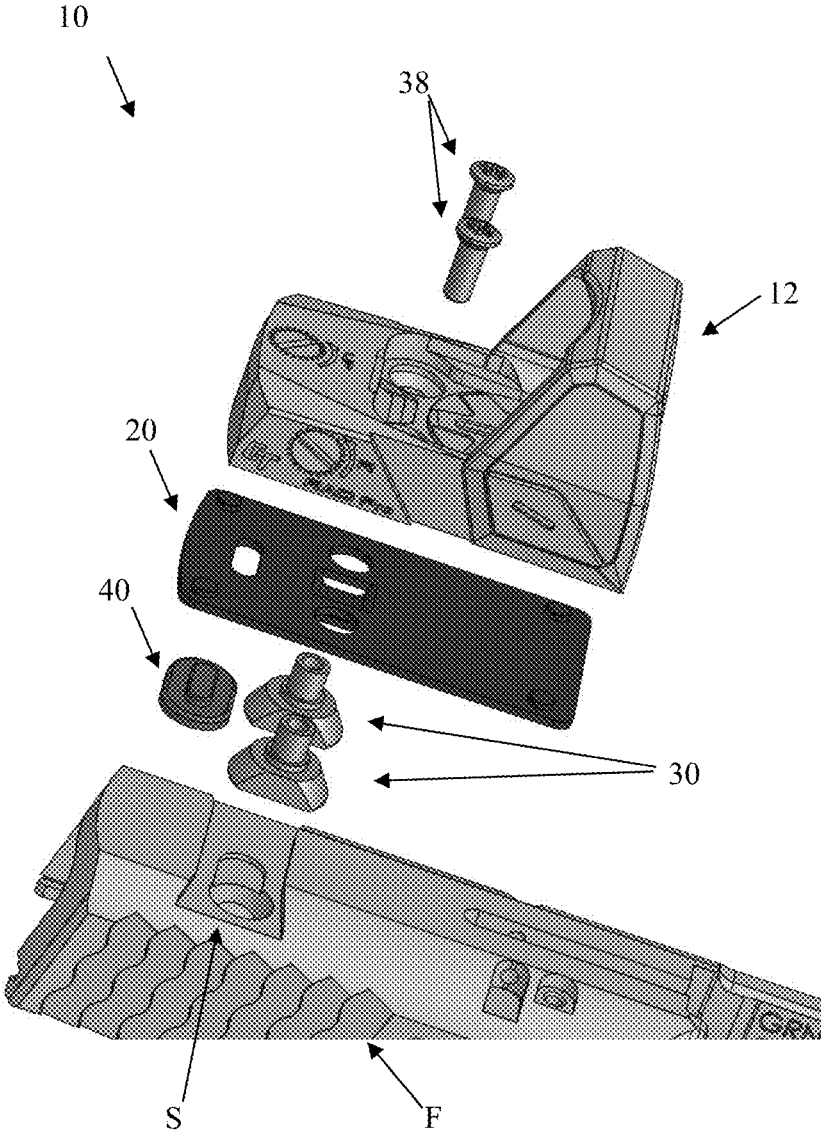
FIG. 1 is an exploded perspective of a firearm accessory mount.
Figure 2:
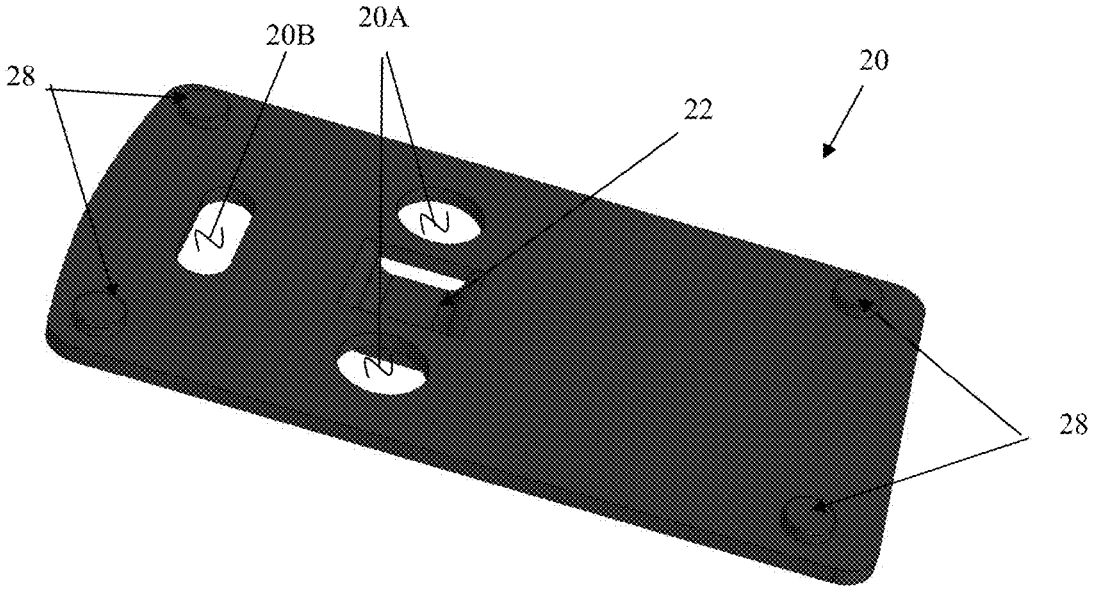
FIG. 2 is a top side perspective of a first embodiment of a mounting plate.

Referring to FIG. 1, the firearm accessory mounting assembly, referred to herein as a mounting assembly is generally indicated by reference number 10. The mount assembly 10 is used to mount an accessory such as a sight 12 (e.g., a red-dot sight), to a firearm, indicated by F, such as a hand gun or pistol. The mount assembly is generally universal and can be used with a wide variety of different accessories and firearms. The mount assembly 10 can be mounted to existing rear sight mounting structure of the firearm; for example, a dovetail slot, indicated by S. The mount assembly can be used to attach other accessories to other types of firearms or other devices. The mount assembly enables toolless (i.e. sight pusher tool not required) installation of the mounting nut(s) with the dovetail slot S. The mount assembly can be used to connect other accessories to a firearm without departing from the scope of the present disclosure.

The mount assembly 10 comprises a mounting plate 20 (broadly, "mount") one or more mounting nuts 30, a shim 40, and one or more mounting screws 38. Other configurations can be used.

Referring to FIGS. 2-5, a first embodiment of the mount 20 includes a forward end facing the muzzle of the firearm and an opposite rearward end. The mount 20 has a top side and an opposite bottom side. The mount 20 defines through holes 20A and a shim locator 20B. The mount 20 includes a protrusion 22 (broadly, anti-rotation structure) arranged between the through holes 20A and alignment bosses 28. The alignment bosses 28 are sized and shaped and arranged to be received in openings 12A (broadly, "receivers") on the bottom of the sight 12 to locate the right relative to the mount. The protrusion 22 extends downwardly from the bottom side of the mounting plate and is sized so it can be received by the dovetail slot S, allowing the mounting plate to lay generally flatwise against the firearm. In the illustrated embodiment, the shim locator comprises a pill-shaped hole or slot sized and shaped to receive a portion of a shim, as will be explained in greater detail below. The mounting plate can be sized and shaped to match the footprint of generally any type of accessory the mount can be used with. In the illustrated embodiment, the mount includes a generally planer mount body from which the alignment bosses 28 and protrusion 22 protrude. Other configurations can be used without departing from the scope of the present disclosure.

A second embodiment of the mount 120 is substantially similar to the first embodiment and includes likes features with like reference numbers plus 100. Differences between the first and second embodiments will be described in greater detail herein. For example, the mount 120 defines holes 120A, a shim locator 120B, and alignment bosses 128. Unlike the first embodiment, the mount 120 includes a centering or center line indicator 124 to help position and align the mount with the centerline of the firearm. The centering indicator can be used to aid in positioning the sight on the firearm centerline without the need of specialized tools or measuring equipment. This sets the sight up on the center of the firearm to minimize the amount of adjustment needed to zero the sight to the firearm.

The centering indicator is disposed along or adjacent to the forward end of the mounting plate, along the longitudinal center line of the mount. In the illustrated embodiment the centering indicator 124 comprises a ridge or projection 26 with sloped and/or curved sides extending forward from the front edge of the mount. However, the centering indicator can include indicia (e.g., a marking such as a line, arrow, letter, geometric shape etc.) on the top surface and/or front edge surface of the mount in addition to or in place of the projection 26. Moreover, the centering indicator can include a different or additional physical element such as a recess or a slot. The centering indicator may comprise any suitable element for indicating the center of the mount. The centering indicator can be formed by machining, marking, stamping, etc. The first embodiment of the mount 20 could be configured to include the center line indicator 124 without departing from the scope of this disclosure. Moreover, unlike the mount 20 the mount 120 defines openings 129 sized shaped and arranged for receiving fasteners for connecting the mount 120 to the firearm. For example, such fasteners may be used for connecting to threaded holes in the firearm.

Figure 6:
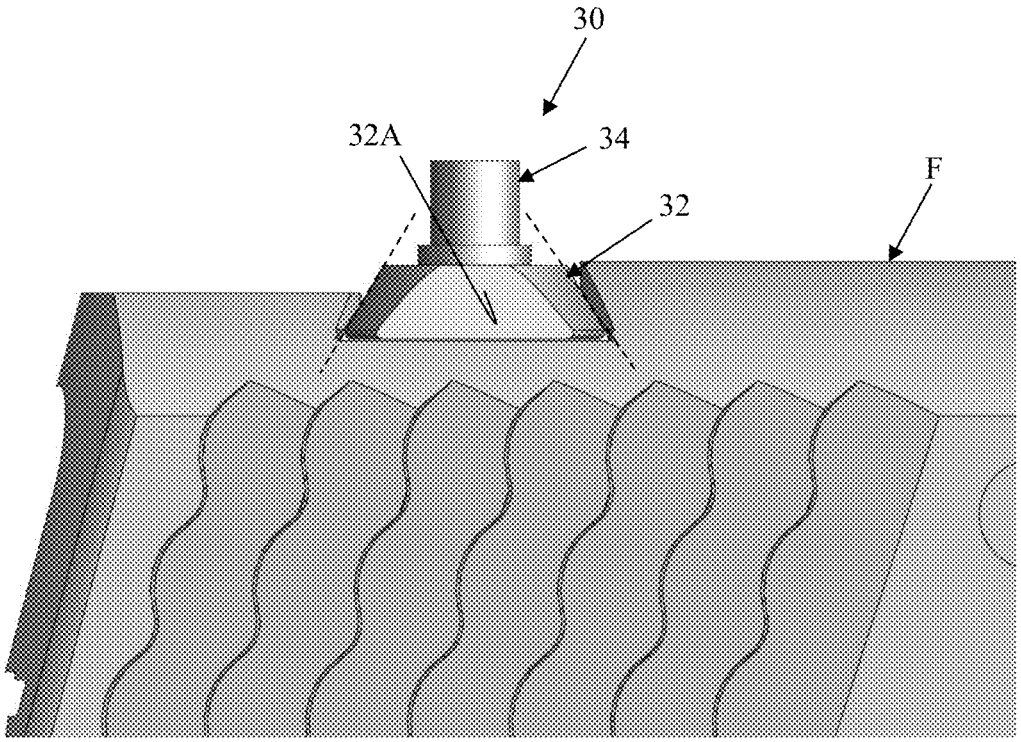
FIG. 6 is an elevation of a mounting nut installed to a slot of a firearm.
Figure 7:
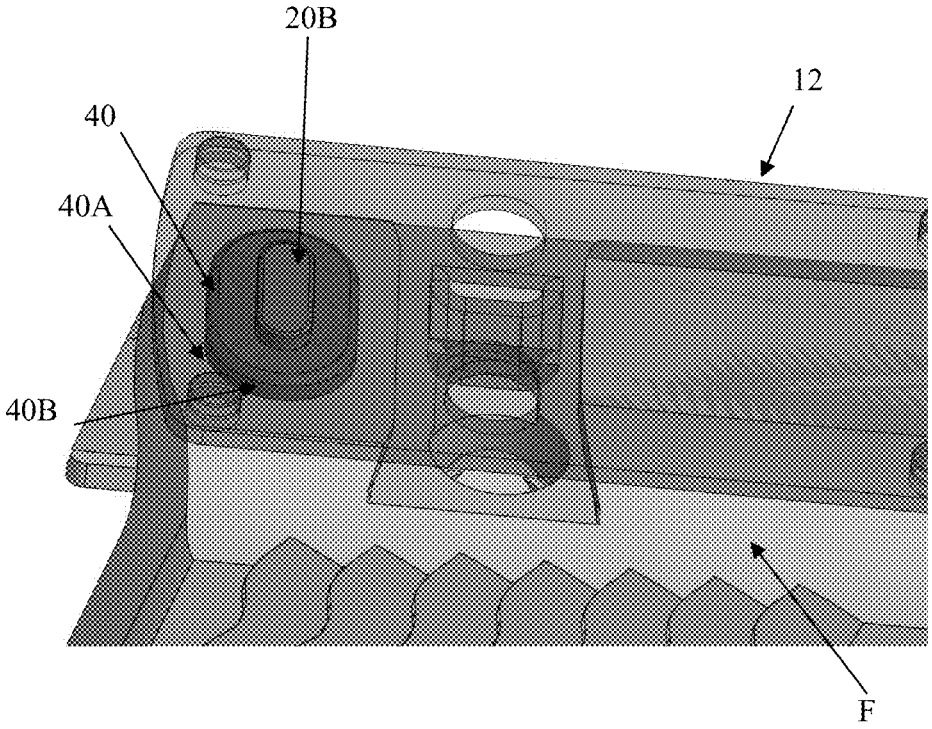
FIG. 7 is a perspective of a shim between the mounting plate and the firearm.
Figure 8:
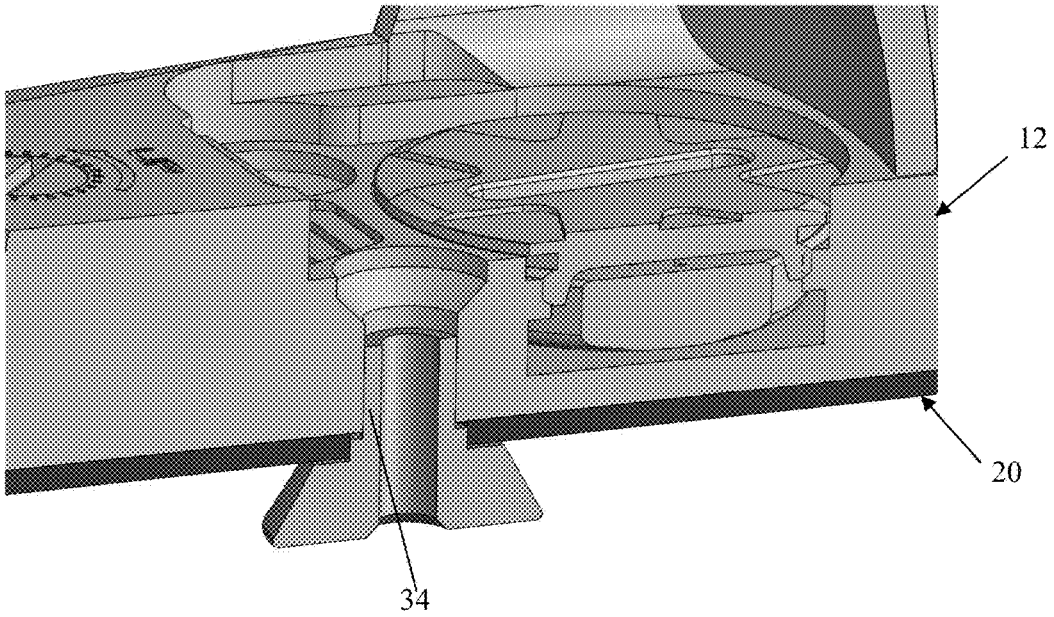
FIG. 8 is a cross section of a post of the mounting nut fitted in an opening of an accessory.

Referring to FIG. 6, each mounting nut 30 is profiled to match the specific geometry of the mounting feature of the firearm. Each mounting nut 30 includes a head 32 and a post 34 extending upwardly from the head 32. The mounting nut 30 is configured to correspond to the geometrical structure of the dovetail slot S. The dovetail slot has angled surfaces and the head 32 has angled surfaces that correspond to angled surfaces of the dovetail slot S of the firearm F. The head includes one or more flats 32A. The post 34 is sized and shaped to be received in a hole of the sight 12. The post 34 is internally threaded. The head 32 is able to form a loose fit with the dovetail slot S to allow the mounting nut 30 to be easily installed by sliding the mounting nut 30 into and along the slot S. The mounting nut 30 may be referred to broadly as a dovetail connector.

Figure 9:
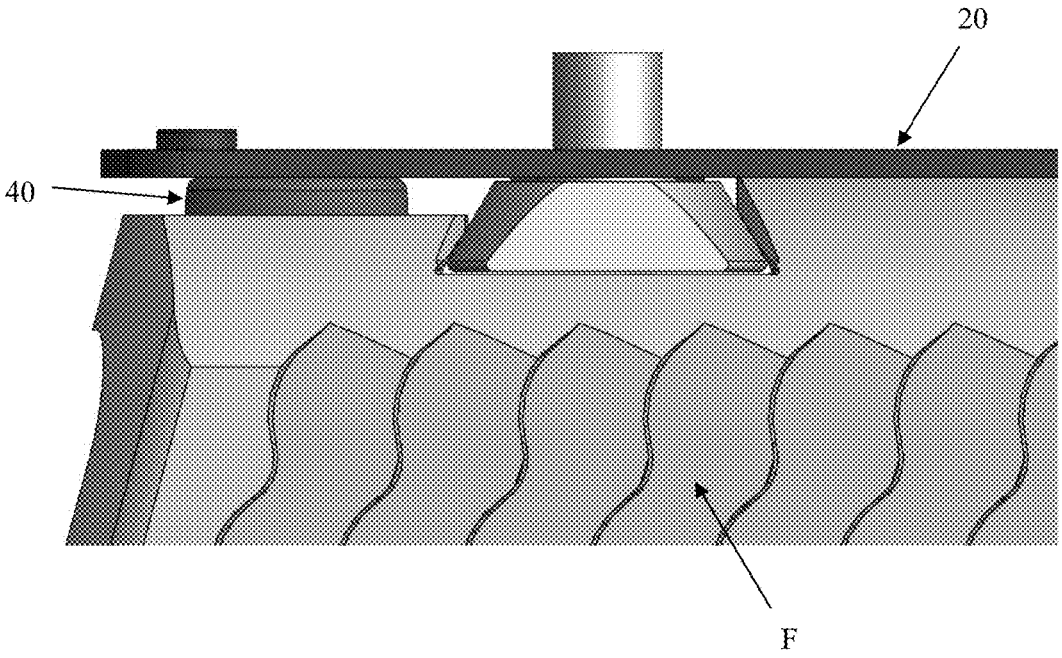
FIG. 9 is an elevation similar to FIG. 6 but with the mounting plate placed over the mounting nut.
Figure 10:
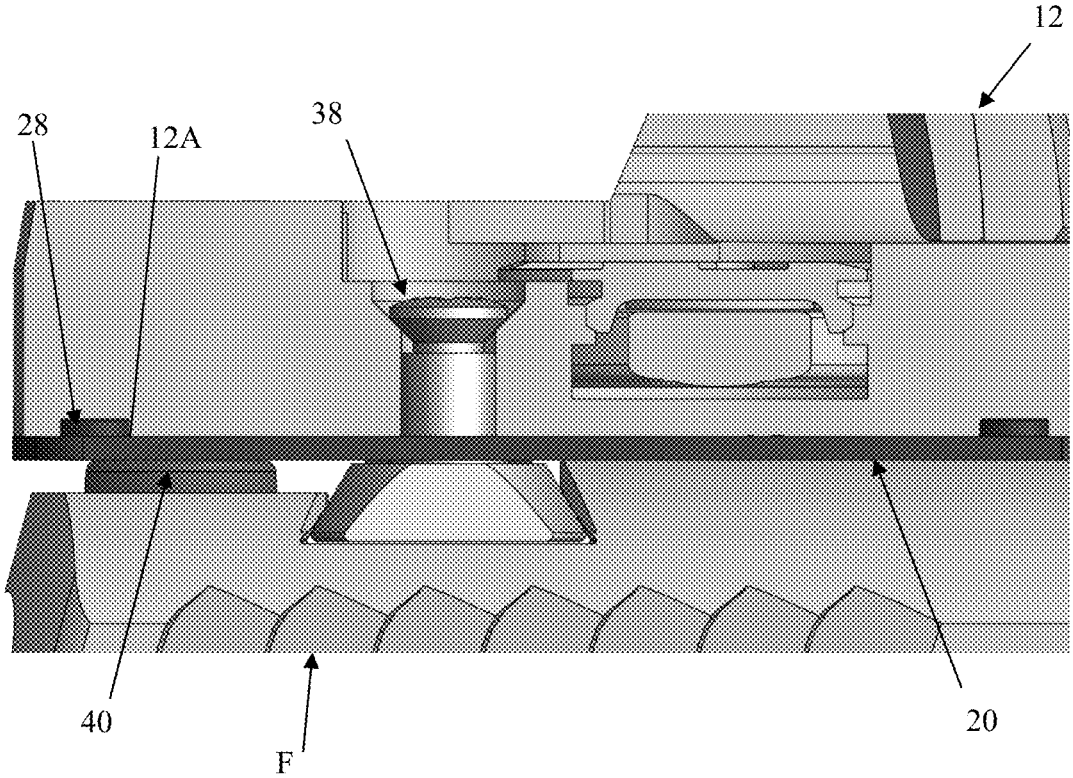
FIG. 10 is a cross section of the accessory installed onto the mount and connected to the firearm.
Figure 11:
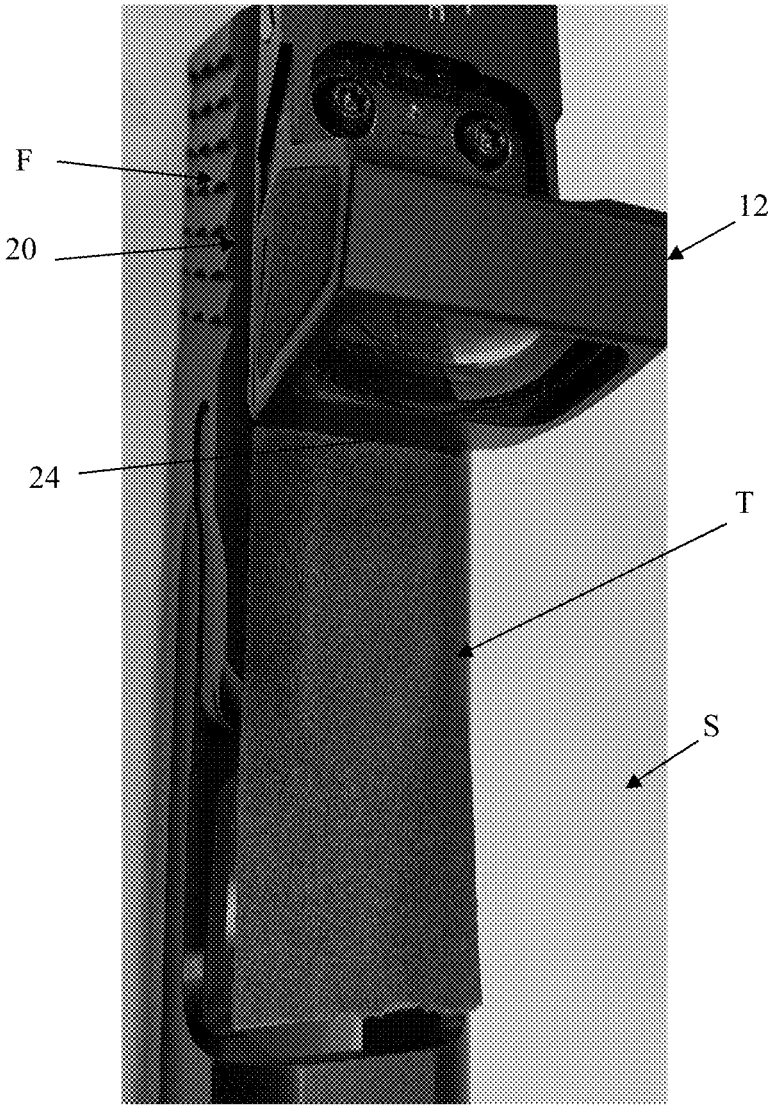
FIG. 11 is a photograph of a top of the accessory installed on a slide of the firearm with a piece of tape shown adhered to a top side of the slide.

As illustrated in FIG. 9, in some instances, portions of the firearm slide on either side of the mounting feature may not be level. The shim 40 can be used to fill the gap between the firearm and the mount. The shim comprises a base 40A and a projection 40B. The shim 40 engages the shim locator opening 20B of the mount 20 for positioning and retention. The shim engages the firearm and the mount to brace the mount when the mount is attached to the firearm. The shim includes a locator or projection that is sized and shaped to engage (e.g., to be received by or inserted into) the shim locator to position and retain the shim.

Figure 3:
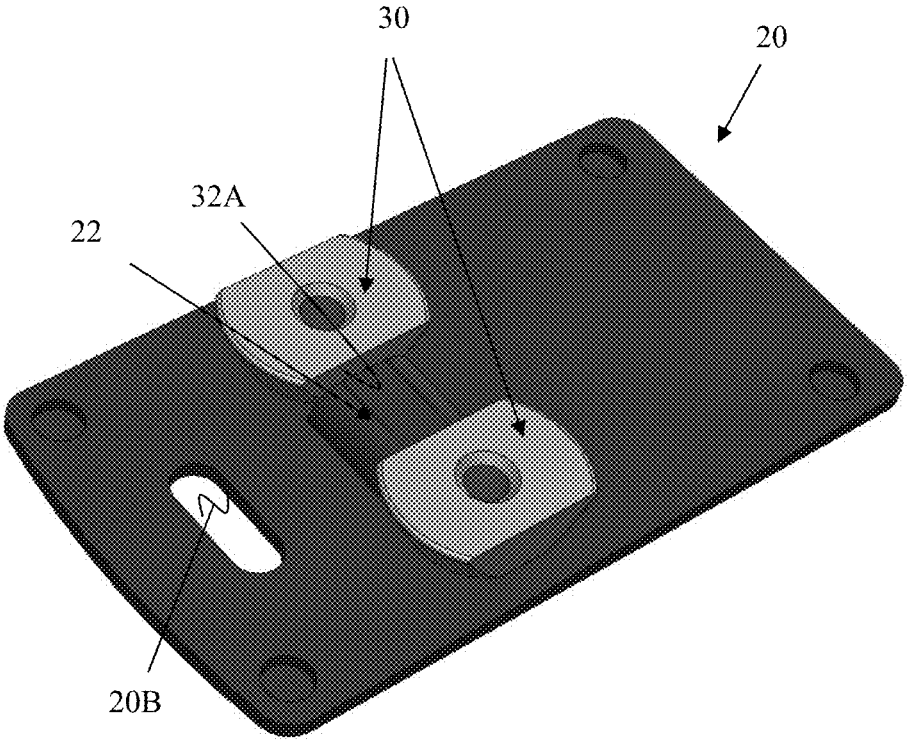
FIG. 3 is a bottom side perspective of the mounting plate with two dovetail connectors.
Figure 4:
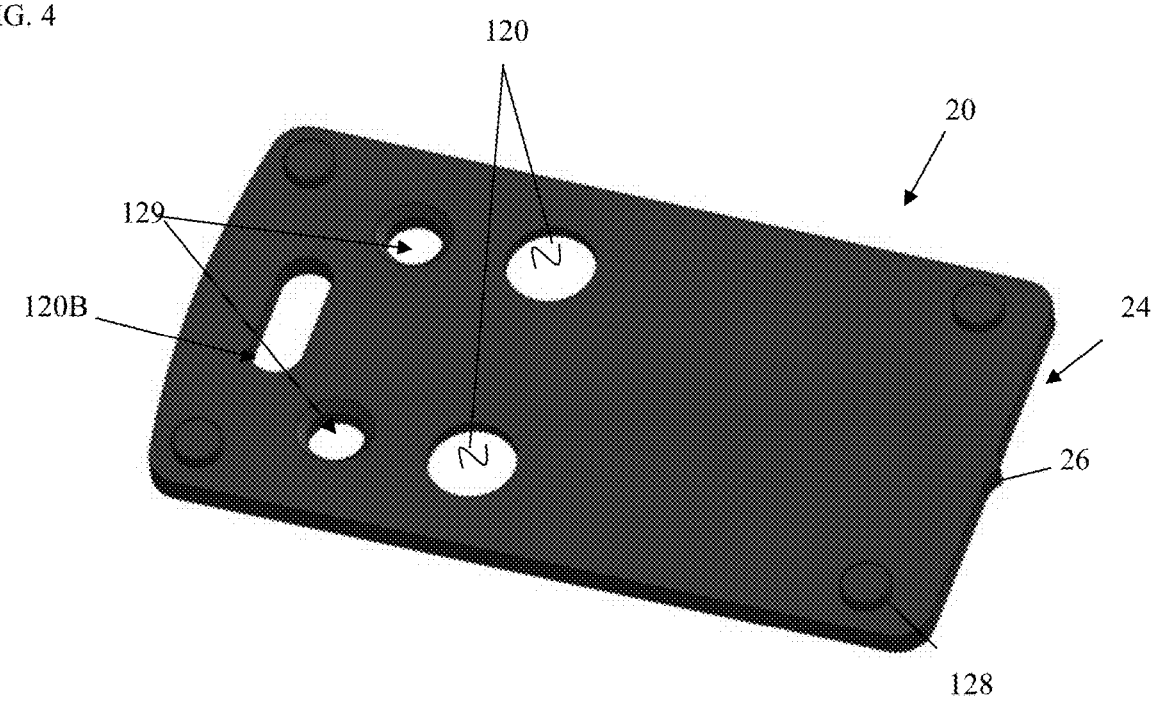
FIG. 4 is a top perspective of a second embodiment of the mounting plate.
Figure 5:
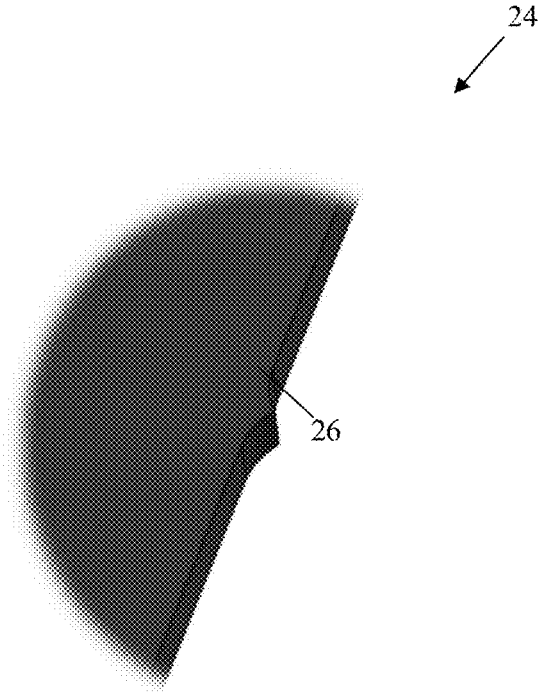
FIG. 5 is a fragmentary perspective of the second embodiment of the mounting plate showing a centering indicator.

An example procedure for installing the sight with mount assembly on the firearm will now be explained. First, the mounting nuts 30 are inserted through the holes 20A of mount 20 and into the holes of the sight and then secured loosely therewith with the mounting screws 38. Next, the heads 32 of the mounting nuts are slid into and along the dovetail slot S of the firearm to position the Mount on the firearm. If needed, the shim 40 is positioned underneath the mount 20. The mounting screws 38 are torqued or tightened. This draws the heads of each mounting nut upwardly toward the mount. As the mounting nut is drawn upwardly, the heads 32 are forced against the sides of the dovetail slot to lock and secure the Mount and sight to the firearm. As best illustrated in FIG. 3, the protrusion 22 engages the flats 32A of the mounting nuts 30 which assists in further preventing the mounting nuts 30 from rotating while the mounting screw 38 is being tightened. The steps can be performed in other orders without departing from the scope of the present disclosure.

In some embodiments, the mount assembly can be provided as a kit having a plurality of different mounts for different types of accessories (e.g., sights), a plurality of different shims (e.g., different thicknesses) for different firearms, and a plurality of different mounting nuts for different types of firearm mounting features. This enables a user to select the mount, mounting nut, and/or shim to be used with a corresponding accessory and firearm.

Figure 12:
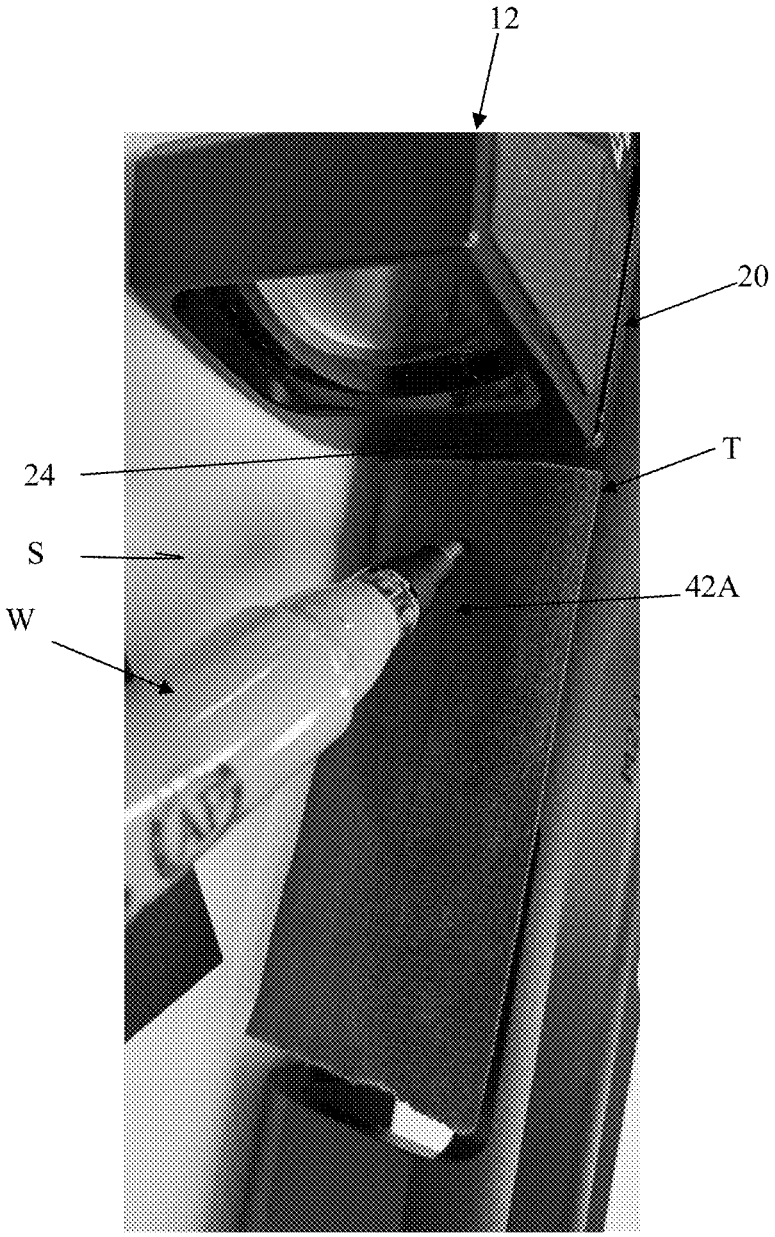
FIG. 12 is a photograph like FIG. 11 but showing a right side of the slide resting on the support surface to facilitate creation of a first reference mark on the tape.
Figure 13:
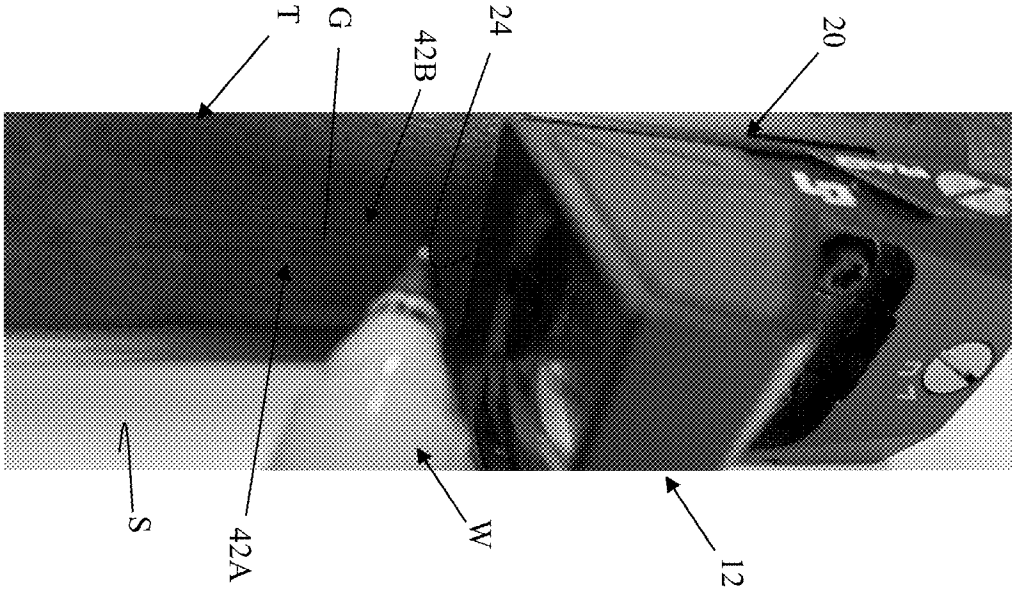
FIG. 13 is a photograph like FIG. 12 but showing the left side of the slide resting on the support surface to facilitate creation of a second reference mark on the tape.
Figure 14:
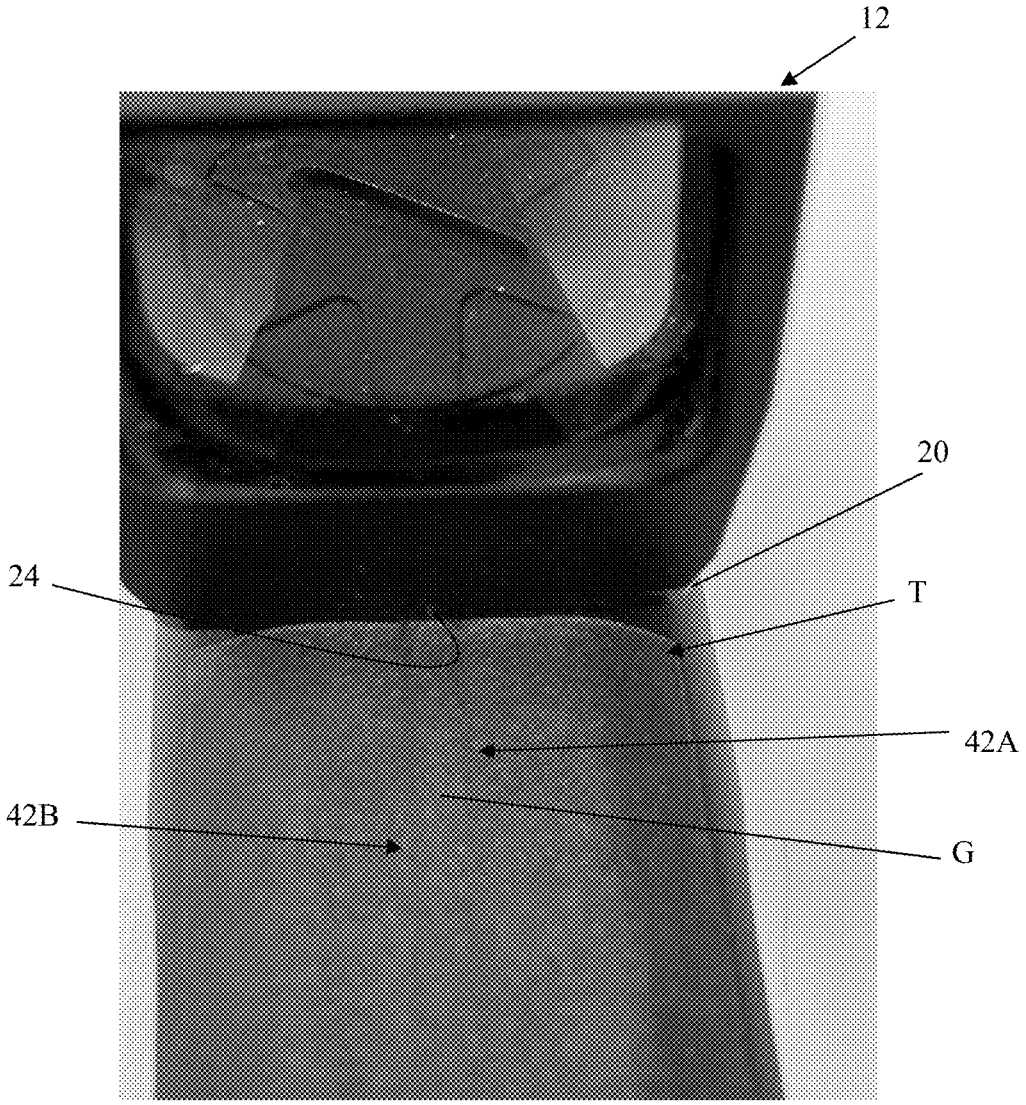
FIG. 14 is an enlarged photograph like FIG. 11 but showing both reference marks on the tape.

Referring to FIGS. 11-14, one method of positioning the mount 20 with the centering indicator 24 will now be described. The steps include, first, loosely fitting the sight 12 and mount 20 to the firearm F. Next, applying removable tape T to the firearm F in front of the sight assembly. Next, placing the firearm (or a portion thereof such as the slide) on its side on a flat surface S. A writing instrument W (e.g., pencil/pen/marker) is placed on the flat surface S. As shown in FIG. 12, while keeping the writing instrument W on the flat surface S, the writing instrument W is moved along the tape T to draw a first line 42A (broadly, reference mark) on the tape T. Next, the firearm or portion thereof is flipped over so that it rests on its other side on the flat surface S. As shown in FIG. 13, while keeping the writing instrument W (e.g., pencil/pen/marker) on the flat surface S, the writing instrument W is moved along the flat surface S to draw a second line 42B on the tape T. As shown in FIG. 13, the drawn lines bound a gap G therebetween. The sight 12 and the mount 20 are adjusted laterally with respect to the firearm F such that the centering indicator 24 is centered between the two scribed lines, 42A, 42B. Finally, the fasteners 38 are tightened to secure the sight 12 and mount 20 in position on the firearm F, and the tape T is removed. It will be appreciated that such alignment of the mount with the firearm results in alignment of the sight with the firearm, and this can reduce the need to adjust the sight to the firearm for proper aiming of the firearm.

It will be apparent that modifications and variations are possible without departing from the scope of the invention defined in the appended claims. The dimensions and proportions described herein are by way of example without limitation. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm accessory mounting system for mounting a firearm accessory on a firearm having a dovetail slot, the firearm accessory mounting system comprising:

a mount configured to receive the firearm accessory thereon;

a dovetail connector moveable with respect to the mount, the dovetail connector including a dovetail head sized and shaped to be received in the dovetail slot of the firearm and to be rotatable within the dovetail slot; and a fastener configured to engage the dovetail connector to secure the dovetail connector in position with respect to the mount;

the mount including an anti-rotation structure arranged to engage the dovetail connector to prevent rotation of the dovetail head within the dovetail slot when the dovetail head is received in the dovetail slot and the fastener engages the dovetail connector.

2. The firearm accessory mounting system as set forth in claim 1, wherein the anti-rotation structure is arranged to engage the dovetail head of the dovetail connector to prevent rotation of the dovetail head within the dovetail slot when the dovetail head is received in the dovetail slot and the fastener engages the dovetail connector.

3. The firearm accessory mounting system as set forth in claim 1, wherein the mount includes accessory connection structure configured to mate with mount connection structure of the firearm accessory to locate the firearm accessory with respect to the mount.

4. The firearm accessory mounting system as set forth in claim 3, wherein the accessory connection structure of the mount includes alignment bosses configured to be received by receivers of the mount connection structure of the firearm accessory.

5. The firearm accessory mounting system as set forth in claim 2, wherein the anti-rotation structure is arranged to be disposed in the dovetail slot of the firearm when the mount is mounted on the firearm.

6. The firearm accessory mounting system as set forth in claim 5, wherein the anti-rotation structure is arranged to engage a flat of the dovetail head to prevent rotation of the dovetail head within the dovetail slot.

7. The firearm accessory mounting system as set forth in claim 1, wherein the mount defines an opening and the dovetail connector includes a post extending from the dovetail head, the post being configured to extend into the opening of the mount.

8. The firearm accessory mounting system as set forth in claim 7, wherein the fastener includes a threaded shaft and the post includes a threaded opening in which the threaded shaft is configured to be received for forming a threaded connection between the fastener and the dovetail connector.

9. The firearm accessory mounting system as set forth in claim 1, further comprising a shim, the shim being moveable with respect to the mount, the shim including mount connection structure and the mount including shim connection structure, the mount connection structure of the shim and the shim connection structure of the mount being configured to connect to locate the shim relative to the mount.

10. The firearm accessory mounting system as set forth in claim 9, wherein the mount connection structure of the shim includes a protrusion and the shim connection structure of the mount includes an opening sized and shaped to receive the protrusion to retain the shim between the firearm and the mount.

11. The firearm accessory mounting system as set forth in claim 1, in combination with the firearm accessory, wherein the fastener is configured to engage the firearm accessory to secure the firearm accessory to the mount.

12. The firearm accessory mounting system and firearm accessory as set forth in claim 11, wherein the firearm accessory includes an opening through which the fastener is receivable to secure the firearm accessory to the mount.

13. The firearm accessory mounting system as set forth in claim 5, wherein the mount includes a bottom surface arranged to engage the firearm when the mount is mounted on the firearm, and wherein the anti-rotation structure comprises a protrusion extending from the bottom surface of the mount.

14. The firearm accessory mounting system as set forth in claim 7, wherein the opening is a first opening, the dovetail connector is a first dovetail connector, and the fastener is a first fastener, and wherein the firearm accessory mounting system further comprises a second fastener and a second dovetail connector, and wherein the mount defines a second opening, the second dovetail connector comprising a dovetail head and a post, the post of the second dovetail connector being configured to extend into the second opening of the mount.

15. The firearm accessory mounting system as set forth in claim 14, wherein the second fastener includes a threaded shaft and the post includes a threaded opening in which the threaded shaft is configured to be received to form a threaded connection.

16. The firearm accessory mounting system as set forth in claim 1, wherein the dovetail connector is a first dovetail connector and the fastener is a first fastener, and wherein the firearm accessory mounting system further comprises a second fastener and a second dovetail connector, the second fastener being configured to engage the second dovetail connector to secure the second dovetail connector in position with respect to the mount.

17. The firearm accessory mounting system as set forth in claim 1, in combination with the firearm accessory.

18. The firearm accessory mounting system as set forth in claim 17, wherein the firearm accessory comprises a firearm sight configured to assist a user in aiming the firearm.

19. The firearm accessory mounting system as set forth in claim 1, wherein the mount includes an alignment indicator configured to indicate an alignment of the mount with respect to the firearm.

20. The firearm accessory mounting system as set forth in claim 10, wherein the protrusion does not extend upward beyond the mount when the shim connection structure and the mount connection structure engage one another.

21. The firearm accessory mounting system as set forth in claim 9, wherein the shim includes a base configured to be located between the mount and the firearm when the firearm accessory mounting system is mounted to the firearm.

22. The firearm accessory mounting system as set forth in claim 21, wherein the shim includes a bottom surface arranged to engage the firearm when the firearm accessory mounting system is mounted to the firearm, a distance between the bottom surface of the shim and a bottom side of the mount configured to engage the firearm when the firearm accessory mounting system is mounted to the firearm being fixed when the firearm accessory mounting system is mounted to the firearm.

23. The firearm accessory mounting system as set forth in claim 9, wherein the mount includes a bottom side configured to engage a first surface of the firearm and the shim is configured to engage a second surface of the firearm, offset vertically from the first surface, when the firearm accessory mounting system is mounted to the firearm.

24. The firearm accessory mounting system as set forth in claim 9, wherein the shim connection structure and the mount connection structure are configured to inhibit the shim from rotating relative to the mount when the shim connection structure and the mount connection structure engage one another.

* * * * *